US005460881A

United States Patent [19]

Hsu

[11] Patent Number: 5,460,881

[45] Date of Patent: Oct. 24, 1995

[54] MAKING A YARN OF PARTICULATE-IMPREGNATED ARAMID FIBERS

[75] Inventor: Che-Hsiung Hsu, Wilmington, Del.

[73] Assignee: E. I. Du Pont de Nemours and Company, Wilmington, Del.

[21] Appl. No.: 172,291

[22] Filed: Dec. 22, 1993

Related U.S. Application Data

[62] Division of Ser. No. 899,897, Jun. 17, 1992, Pat. No. 5,298,028.

[51] Int. Cl.[6] ..... B32B 27/02; D02G 3/02

[52] U.S. Cl. ..... 428/357; 8/130.1; 8/115.6; 8/492; 57/250; 57/258; 427/180; 427/307; 427/322; 428/372; 428/374; 428/375

[58] Field of Search ..... 57/250, 258; 427/180, 427/307, 322; 8/130.1, 115.6, 492; 428/357, 364, 367, 372, 374, 375, 383, 384

[56] References Cited

U.S. PATENT DOCUMENTS

| | | | |
|---|---|---|---|
| 3,823,035 | 7/1974 | Sanders | 117/226 |
| 4,255,487 | 3/1981 | Sanders | 428/368 |
| 4,375,632 | 3/1983 | Miyamoto et al. | 338/214 |
| 4,525,384 | 6/1985 | Aoki et al. | 427/174 |
| 4,545,835 | 10/1985 | Gusack et al. | 156/180 |
| 4,704,311 | 11/1987 | Pickering et al. | 427/393.1 |
| 4,759,770 | 7/1988 | Cates et al. | 8/130.1 |
| 4,985,046 | 1/1991 | Hartzler | 8/654 |

FOREIGN PATENT DOCUMENTS

| | | |
|---|---|---|
| 121132 | 3/1984 | European Pat. Off. . |
| 0136727 | 4/1985 | European Pat. Off. . |
| 2230133 | 2/1990 | United Kingdom . |

*Primary Examiner*—James J. Seidleck
*Assistant Examiner*—John M. Cooney, Jr.

[57] ABSTRACT

A process is disclosed for treating aramid fibers with a dispersion of particulate material in a swelling solvent to yield embodiment of the particles in the surface of the fibers.

5 Claims, 2 Drawing Sheets

MAKING A YARN OF PARTICULATE-IMPREGNATED ARAMID FIBERS

This is a division of application Ser. No. 07/899,897, filed Jun. 17, 1992, now U.S. Pat. No. 5,298,028.

BACKGROUND OF THE INVENTION

1. Field of the Invention

The present invention relates to making yarns of aramid fibers having particulate material embedded in the surface of the individual fibers.

2. Description of the Prior Art

U.S. Pat. No. 3,823,035 issued Jul. 9, 1974 on the application of Sanders, discloses suffusing carbon black particles into the surface of nylon monofilaments by dissolving nylon at the surface of the monofilament and contacting the dissolved nylon with the carbon black.

U.S. Pat. No. 4,985,046 issued Jan. 15, 1991 on the application of Hartzler discloses treating the surface of aramid fibers with concentrated sulfuric acid to make the fibers more receptive to dyes and dye-promoting agents.

U.S. Pat. No. 4,525,384 issued Jun. 25, 1985 on the application of Aoki et al. discloses a process for heat treating yarns of aromatic polyamide filaments which avoid interfilament adhesion by sticking particulate spacer material to the surface of the fibers by a coating process with an aqueous dispersion.

SUMMARY OF THE INVENTION

The present invention provides a process for manufacturing a yarn of a multitude of individual filaments of polymeric material having the individual filaments separated from each other and having finely-divided particulate material partially embedded in the surface of the individual filaments comprising the steps of: a) establishing a liquid system of (i) a first liquid capable of swelling the polymeric material and (ii) a finely-divided particulate material dispersed therein; b) contacting a yarn of a multitude of individual, dried, filaments of the polymeric material with the liquid system for a time adequate to swell the polymeric material at the surface of the filaments; c) contacting the swollen polymeric material with a second liquid which is a solvent for the first liquid and a nonsolvent for the polymeric material.

The invention also provides a multifilament yarn product of the process having finely-divided particulate material partially embedded in the surface of the individual filaments.

The polymeric material of the filaments is preferably aramid and the aramid is preferably poly(p-phenylene terephthalamide). The particulate material is preferably graphite.

DETAILED DESCRIPTION OF THE INVENTION

Figure 1:
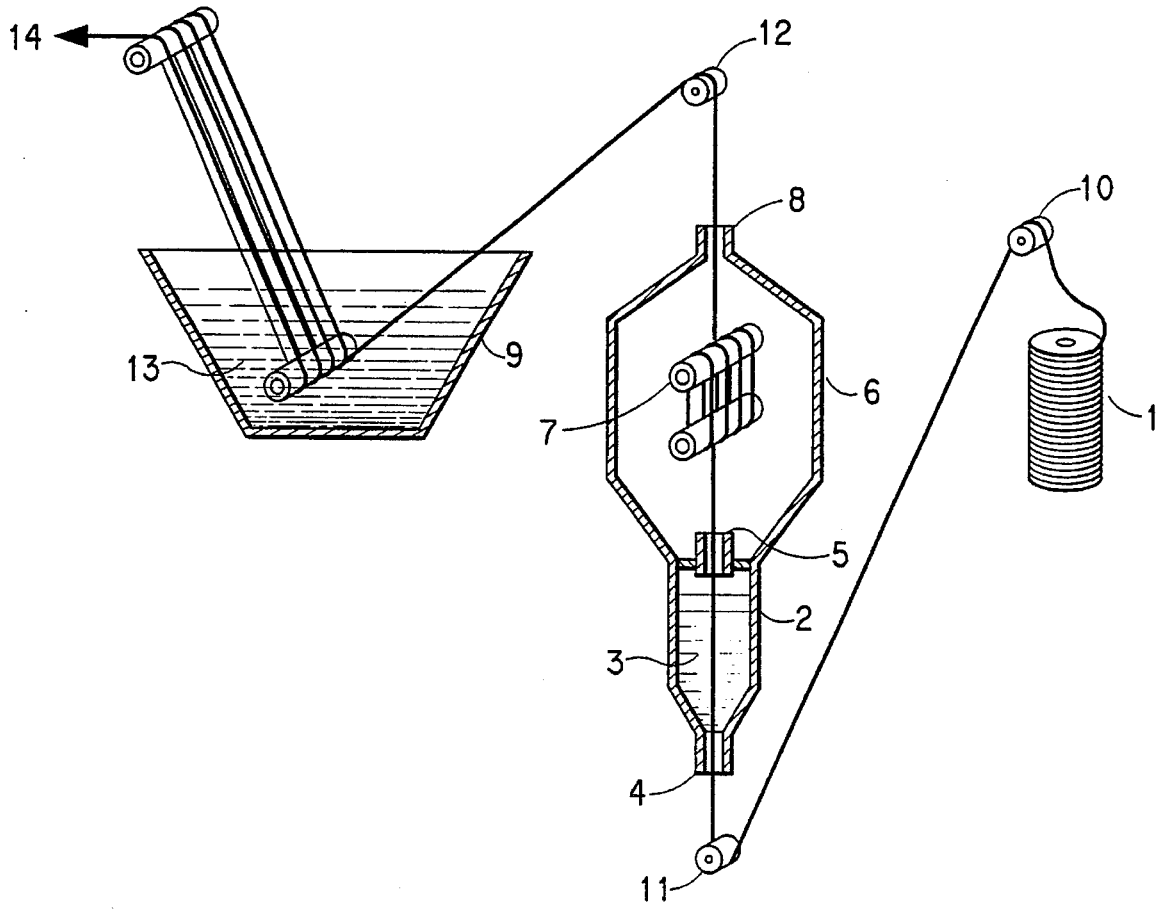
FIG. 1 is a simplified representation of an apparatus useful for conducting the process of this invention.

This invention relates to fibers which have particulate materials embedded into a very thin layer of the surface. There is a need for such fibers for a variety of purposes. Abrasive particles ban be embedded into fibers to increase the coefficient of friction or the abrasiveness of the fibers. Lubricant particles can be embedded to decrease the coefficient of friction. Conductive particles can be embedded to create an electrically conductive surface. This invention is particularly directed toward fibers which have conductive particles embedded therein to yield fibers with a conductive surface. Such fibers are useful as precursors for high frequency energy absorbers, electrolytic plating, automobile ignition cables, and as antistatic fibers.

By "fibers" is meant continuous or short fibers or filaments. Uncut fibers of this invention are made with continuous filament yarns; and fibers of this invention are then used to make staple or floc or pulp by cutting and, if necessary, refining. The so-manufactured staple or floc or pulp of this invention is used to make the same products which are customarily made from short fibers which have not been modified by the process of this invention.

By "aramid" is meant a polyamide wherein at least 85% of the amide (—CO—NH—) linkages are attached directly to two aromatic rings. Additives can be used with the aramid and it has been found that, for practice of this invention, up to as much as 20 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. PPD-T also includes combination of polyvinyl pyrrolidone with poly(p-phenylene terephthalamide), as taught in U.S. Pat. No. 5,073,440.

Para-aramids are the primary aramids in fibers of this invention and poly(p-phenylene terephthalamide) (PPD-T) is the preferred para-aramid. By PPD-T is meant the homopolymer resulting from mole-for-mole polymerization of p-phenylene diamine and terephthaloyl chloride. PPD-T, also, means copolymers resulting from incorporation of other aromatic diamines and other aromatic diacid chlorides such as, for example, oxydianiline, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

The fibers of this invention are customarily spun from a liquid solution of the desired polymeric material. In the case of aramids, the spinning is customarily wet spinning into a coagulating bath and, in the case of para-aramids, the wet spinning is what is customarily known as air-gap spinning. In the case of para-aramids, the spinning solutions are usually anisotropic.

The fiber-treating process of this invention is conducted on yarns of a multitude of fibers; and the individual fibers remain separated from and unattached to neighboring fibers. It is very important to be able to treat individual fibers in a yarn of a multitude of fibers because there is often a need to treat a high volume of fibers and a need to maintain the fibers separate and individual from each other. The process of this invention provides for treatment of individual fibers in a multifilament yarn without interfilament adhesion.

The process of this invention is conducted on aramid fibers which have been previously dried. Aramid fibers which have been spun but never dried can be treated by process of the prior art; but, once dried, the structure of aramid fibers is collapsed and closed. Once dried, yarns of aramid fibers cannot be impregnated with particulate solids unless the fiber structure is opened somewhat.

In order to impregnate the surface of individual fibers in a yarn or tow while maintaining the separate relation of the fibers by the process of this invention, it is important that the surface of the fibers being impregnated must be swollen and not dissolved in preparation for the impregnation step. In the case of PPD-T, the liquid system used for swelling the surface of the fibers is sulfuric acid of a carefully controlled concentration. It has been discovered that exposure of PPD-T to sulfuric acid greater than 88% results in dissolution of the PPD-T; and exposure of PPD-T to sulfuric acid in the range of 70% to 88% results in swelling of the PPD-T. It is believed that practice of the process of this invention using sulfuric acid with a concentration greater than 88% results in yarns of fibers wherein the surfaces of individual fibers have been dissolved to the point that the fibers adhere to neighboring fibers. When the sulfuric acid concentration is in the range of 70% to 88%, the surface of the PPD-T fibers is only swollen and neighboring fibers do not adhere together. At or below a concentration of 70%, the sulfuric acid appears to be an inadequate swelling agent for the PPD-T.

In establishing the liquid system for swelling the fibers, a liquid is selected which is known to swell the polymeric material of the fibers without dissolving it. Sulfuric acid in the concentration range of 70% to 88% is such a liquid system for swelling PPD-T. The liquid system can be made up of a combination of liquids if the combination, otherwise, meets the requirements of the system. In one way of thinking, the sulfuric acid is a combination of the acid and water.

The particulate material for embodiment into the swollen fiber surfaces is selected to accomplish the intended purpose. The particulate material should be unreactive with the liquid system, should be capable of forming a smooth, fluid, dispersion with the liquid system, and should be of small particle size, preferably less than one micrometer. For example, the average particle size for graphite used in this invention is in the range of 0.5 micrometer. The particulate material should be dispersed in the liquid system in a concentration of from 1 to 10 grams per 100 grams of dispersion. Although the benefits of this invention may be realized from the use of particulate materials at all concentrations, there are practical limits which should be observed. For example, it has been found that graphite concentrations of less than 5 grams per 100 grams of dispersion generally yield fibers having unacceptably high electrical resistance. An upper concentration for the particulate material is generally a matter of convenience. It has been found that, at concentrations greater than about 10 grams of graphite per 100 grams of dispersion, the dispersion becomes too viscous for effective use.

Particulate materials can be any of the following: carbon black, graphite, and the like, for electrical and lubricant applications; zeolites, and the like, for catalysis support applications; and lead silicate, vermiculite, and the like, for mechanical applications.

Continuous yarns to be treated by the process of this invention can be of any overall linear density and can be made up of any number of individual filaments. The primary benefit of this invention resides in the fact that this process enables embodiment of the fibers with particulate material while the fibers are in a yarn or tow form and the treated yarn product has individual filaments which are separate and not adhered to neighboring filaments. Yarns eligible for treatment by this process are limited in size only by the need to contact all of the filaments in the yarn by the liquid system. Yarns for treatment are generally from 50 to 15,000 denier; and are usually made up of individual filaments from 1.25 to 2.25 denier. The fibers to be treated by the process of this invention have been previously dried.

The yarn to be treated is contacted by the liquid system, preferably, by being immersed in the liquid system. The contact may, also, be accomplished by spraying, brushing, daubing, and the like, with care being exercised to maintain dispersion of the particulate material and contact of the dispersed particulate material with the swollen fibers. The time of contact for the yarn with the liquid system is the time necessary to swell the polymeric material of the fiber. The time to swell is somewhat related to the temperature of the liquid system and to the history of the fiber, itself.

In the case of fibers made from PPD-T, the time to swell is, also, related to the concentration of the sulfuric acid;—the higher the concentration and the higher the temperature, the shorter the time to swell. It has been found that PPD-T fibers are adequately swollen in 87% sulfuric acid at 25° C., by immersion for 30 seconds. Contact for longer times (for example, greater than 5 minutes) tends to cause some dissolution which results in tackiness in the fibers and in fiber-to-fiber adhesion.

As a demonstration of the difference between swelling and dissolving, fibers of PPD-T were treated with sulfuric acid of various concentrations and weight loss of the fibers was determined. The fiber samples were washed with ethanol and acetone, dried, and weighed. The samples were placed in a bath of acid and were gently agitated for, in one case one minute and, in another case, five minutes. The samples were, then, washed with water, dried, and weighed. Test results are shown below:

| | Sulfuric Acid Concentration (weight %) | | | | |
|---|---|---|---|---|---|
| | 80 | 85 | 87 | 89 | 91 |
| One Minute weight loss (%) | 0.29 | 0.00 | 1.74 | 2.23 | 5.62 |
| Five Minutes | 0.14 | 0.15 | 1.97 | 4.53 | 52.86 |

It is seen that, for PPD-T fibers, sulfuric acid concentrations of about 89 weight percent and higher lead to dissolution of the polymeric material and are not acceptable for practice of this invention.

Contact of the fibers with the liquid system causes swelling of polymeric material at the fiber surface and, by mechanisms not entirely understood, embedment of the particulate material into the swollen surface.

After contact of the fibers with the liquid system, the fibers are contacted with a second liquid which is a solvent for the first liquid and a nonsolvent for the polymeric material. The effect of this contact is believed to be that the first liquid is absorbed out of the swollen volume of the polymeric material; and the polymeric material, consequently, shrinks or collapses back to its unswollen state. In so-collapsing, the polymeric material shrinks around the individual particles of particulate material and entraps, or partially embeds them. The time required for this absorption of the first liquid is very short—on the order of 1 second; and is, to a minor degree, a function of the temperature of the second liquid. While the temperature of the second liquid is not critical, it is customary for the temperature of the second liquid to be maintained from 5° to 25° C.

As a specific description of the practice of this invention, reference is made to FIG. 1.

Yarn for treatment is drawn off of bobbin 1 and passed over and under pins 10 and 11 upwardly through entrance 4 of tube 2 containing graphite/sulfuric acid dispersion 3. Entrance 4 is constricted allowing the yarn to pass but substantially preventing dispersion 3, which is quite viscous, from exiting. The yarn picks up a coating of dispersion 3 as it passes through tube 2 and proceeds through constricted exit 5, which strips excess entrapped dispersion 3 from the yarn, into chamber 6. The yarn then passes over rolls 7 which spread the yarn ensuring intimate contact of dispersion 3 with filaments of the yarn. A blanket of nitrogen can be maintained in tube 2 and chamber 6 to prevent contamination of the liquid system by moisture. The yarn is passed through hole 8, over pin 12, and into bath 9 where it is passed, on rolls 13, repeatedly through the bath with constantly replenished water to assure thorough washing. In the case of aramid fibers and a liquid system of sulfuric acid, the washed yarn is then passed on to neutralization and windup 14 (not shown) where it is contacted with about 8 weight percent sodium bicarbonate solution and water washing for neutralization; and is then guided through a tension gate and over a drive roll, being wound on a bobbin.

Test Methods

Electrical Resistance

A wet sample cut from a section of treated yarn is wrapped at two locations six inches apart with a thin strip (2 mm wide) of aluminum foil. The sample is clamped at each piece of aluminum foil; and the clamps serve as electrical resistance measurement terminals. The wet sample is held tightly between the clamps while it is drying to ensure that individual filaments touch each other closely. Resistance is measured with an electrometer. Resistance readings are not recorded until the sample is dry. Once the "As Made" resistance is recorded, the sample, while the clamps are still on, is rubbed with a tissue against a glass plate and the "Rubbed" resistance is determined. Electrical resistance is expressed as kilo-ohms/6 inches.

Denier

The denier of a yarn is determined by weighing a known length of the yarn. Denier is defined as the weight, in grams, of 9000 meters of the yarn.

DESCRIPTION OF THE PREFERRED EMBODIMENTS

Examples 1–7

A multifilament aramid yarn was directed into a reservoir containing a dispersion of graphite in sulfuric acid. The yarn had 1000 filaments, was about 1500 denier, and was the PPD-T product sold by E. I. du Pont de Nemours and Company under the trademark designation Kevlar 29. The yarn was run over rollers to ensure that each filament was wetted by the dispersion and the speed of the yarn was adjusted to maintain control of the contact time of the yarn with the dispersion. That contact was followed by immersing the yarn in a neutralizing bath with about 8 weight percent sodium bicarbonate and, then, extensively washing the yarn with water. The treated yarn was directed through a tension gate and a drive roll and was wound up on a bobbin.

The steps described above were done in sequence continuously. It was found that the tension between the tension gate and the drive roll should be at least 0.3 grams per denier to improve the homogeneity of electrical conductivity of the impregnated yarn. It was found that the acid concentration must be higher than 70 weight percent to yield fibers exhibiting electrical resistance of acceptably low values (about 300 kilo-ohm/6-inches). It was found that the graphite-coated yarn product of this process contains at least 4 weight percent graphite to exhibit a resistance less than 300 kilo-ohm/6-inches. It was, also, found that the graphite-coated yarn product treated with the most severe conditions (87% $H_2SO_4$ for 60 seconds) still retained at least 85% of the original (untreated) yarn breaking load.

Treated filaments are completely separable so long as the acid concentration is equal to or less than about 88 weight percent and each filament is impregnated with graphite. Electrical resistance of the treated yarn was not greatly affected when the yarns were subjected to rubbing against a dry, hard surface. Observation under an optical microscope revealed that the filament surfaces have distinct longitudinal cracks with graphite included in the cracks when the acid concentration is kept between 85 and 88 weight percent.

The results of Examples 1–7 are shown in the table, below:

| | | | Acid | Graph. | Resistance | |
|---|---|---|---|---|---|---|
| Ex. | Graph. Conc. | $H_2SO_4$ Conc. | Contact Time | On Fiber | As Made A/B | Rubbed A/B |
| 1 | 8% | 87% | 30 sec | 7.7% | 8.0/10.2 | 9.9/12.3 |
| 2 | 8 | 87 | 60 | 9.2 | 5.1/6.8 | 6.0/8.0 |
| 3 | 5 | 87 | 30 | 8.3 | 39.2/46.1 | 56.0/60.0 |
| 4 | 8.5 | 85 | 60 | 5.2 | 10.8/12.4 | 13.2/13.5 |
| 5 | 8.5 | 70 | 60 | 1.5 | >10,000 | |
| 6 | 7.5 | 75 | 60 | 4.0 | 135/86 | 44/55 |
| 7 | 0 | 89 | 30 | 0 | Fibers stuck together | |

Figure 2:
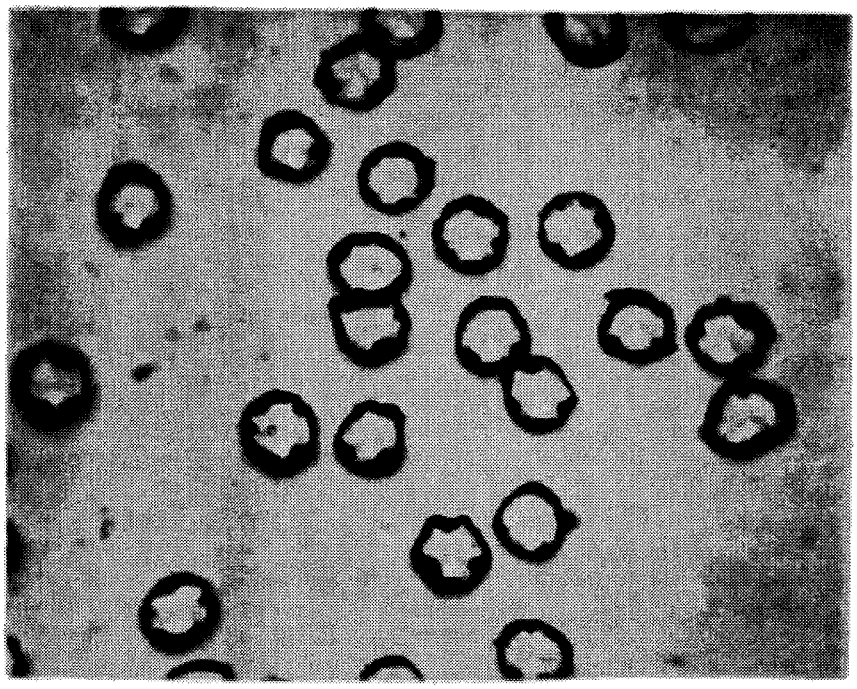
FIG. 2 is a photograph of a cross-section of several individual filaments made by the process of this invention.
Figure 3:
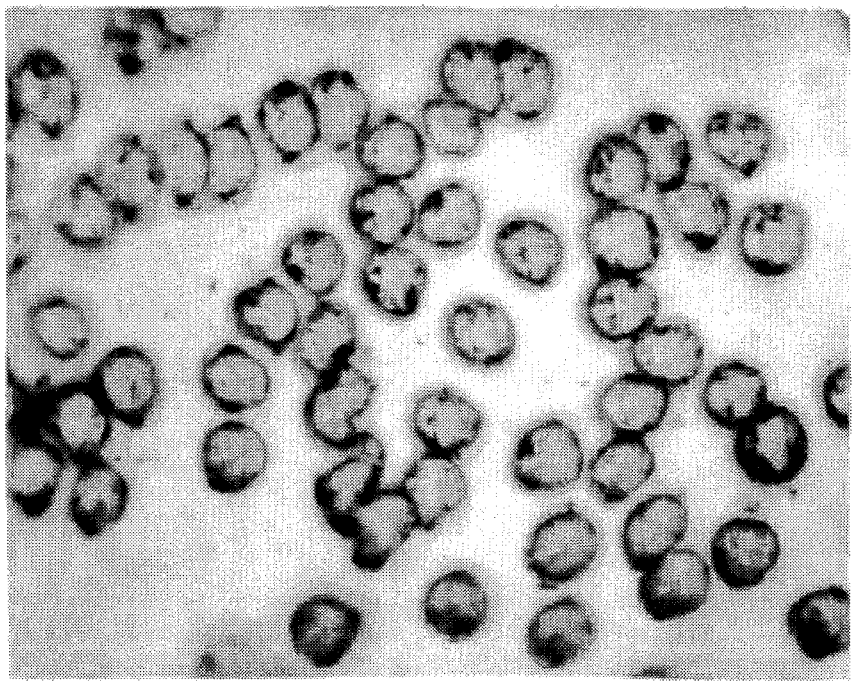
FIG. 3 is a photograph of a cross-section of several individual filaments treated by a process outside the scope of this invention.

To determine deterioration of the yarn as a result of the treatment, the breaking load was determined for yarns from Examples 1 and 2. The untreated control yarn exhibited a breaking load of 72.1 pounds. The treated yarns of Examples 1 and 2 exhibited breaking loads of 64.5 and 62.1 pounds, respectively. The values for A and B represent values for independent samples in separate trials. FIG. 2 is a photographic representation of the treated fibers of Example 1, in cross-section and magnified 630 times. The wide, dark, border around each fiber is graphite partially embedded in the fiber surface by the process of this invention. FIG. 3 is a photographic representation of the treated fibers of Example 5, also, in cross-section and magnified 630 times. The absence of a significant border indicates that little or no graphite was embedded or adhered in the course of the treatment process.

Example 8

As a demonstration of the effect of mechanical working of the wet impregnated fibers on the embedment of particles in practice of this invention, the procedure of Example 1 was repeated except that a pair of ceramic rods was installed between the tension gate and the drive roll to increase yarn tension during contact with the liquid system graphite dispersion. The yarn of Example 1 was used with the same liquid system and the contact time was 60 seconds. The yarn tension between the ceramic rods and the drive roll was about 800 grams (about 0.5 gram per denier). The treated yarn contained 8.9 weight percent graphite. Electrical resistances (kilo-ohm/6-inches) of three undisturbed samples, i.e., filaments were lightly touched to each other, cut from one section of the treated yarn were 4.5, 4.8 and 4.6. The electrical resistances were practically unchanged at 5.3, 4.8, and 4.6, respectively, when the yarns were disturbed gently to separate the filaments completely. The differences in electrical resistance between undisturbed and disturbed samples were very small.

For comparison, a graphite-coated yarn was made without tensioning over the ceramic rods. The yarn tension in that case was about 190 grams (about 0.12 gram per denier). The treated yarn contained 9.6 weight percent graphite. Electrical resistances of three undisturbed samples cut from one section of the treated yarn were 6.1, 6.3 and 6.7. The electrical resistances went up to 11.0, 11.5, and 11.7, respectively, when the yarns were disturbed gently to separate the filaments completely. The increased tension after collapse of the swollen polymer, neutralization, and washing was found to decrease the electrical resistance even further.

I claim:

1. A yarn product comprising a multitude of individual filaments of poly(p-phenylene terephthalamide) polymeric material having the individual filaments separated from each other and having finely-divided particulate material partially embedded in the surface of the individual filaments and manufactured by a process comprising the steps of:

a) establishing a liquid system of (i) a first liquid of sulfuric acid in a concentration of 70 to 88 percent capable of swelling the poly(p-phenylene terephthalamide) polymeric material and (ii) the finely-divided particulate material dispersed therein;

b) contacting a yarn of a multitude of individual filaments of the polymeric material with the liquid system for a time adequate to swell the polymeric material at the surface of the filaments;

c) contacting the swollen polymeric material with a second liquid which is a solvent for the first liquid and nonsolvent for the polymeric material.

2. The yarn product of claim 1 wherein the particulate material is clay.

3. The yarn product of claim 1 wherein the particulate material is graphite.

4. The yarn product of claim 1 wherein the particulate material is present in a concentration of from 1 to 10 weight percent of the total yarn product.

5. The yarn product of claim 1 wherein the particulate material is graphite and the yarn contains at least 4 weight percent graphite and exhibits a resistivity of less than 300 kilo-ohms/6-inches.

* * * * *